United States Patent [19]

LaPorte

[11] Patent Number: 4,793,012

[45] Date of Patent: Dec. 27, 1988

[54] BEACH MAT ADAPTED FOR USE ON A LOUNGE CHAIR

[76] Inventor: Victor J. LaPorte, 1807 Bittersweet Ln., Mt. Prospect, Ill. 60056

[21] Appl. No.: 879,003

[22] Filed: Jun. 26, 1986

[51] Int. Cl.[4] ..... A47G 9/06; A45C 9/00; A47C 31/10

[52] U.S. Cl. ..... 5/420; 5/498; 5/500; 190/2; 297/218; 383/4

[58] Field of Search ..... 5/485, 482, 420, 417, 5/413, 498, 500, 502; 297/218, 219, 229, 441; 383/4; 190/2

[56] References Cited

U.S. PATENT DOCUMENTS

| | | | |
|---|---|---|---|
| 1,219,437 | 3/1917 | Butler | 297/377 |
| 1,930,942 | 10/1933 | Pringle | 5/419 |
| 2,183,418 | 12/1939 | Williams | 5/420 X |
| 2,505,492 | 4/1950 | Heider | 5/420 X |
| 2,707,988 | 5/1955 | Shaub et al. | 5/413 X |
| 2,713,890 | 7/1955 | Mack | 297/377 X |
| 2,783,473 | 3/1957 | Humpeler | 5/417 X |
| 2,898,609 | 8/1959 | Storie | 5/419 |
| 3,176,315 | 4/1965 | Freund | 5/417 X |
| 4,058,341 | 11/1977 | Prins | 297/218 X |
| 4,154,323 | 5/1979 | Sneider | 5/417 X |
| 4,165,125 | 8/1979 | Owen | 5/485 X |
| 4,192,548 | 3/1980 | Williams | 297/218 X |
| 4,208,070 | 6/1980 | Greschwender | 5/432 X |
| 4,273,380 | 6/1981 | Silvestri | 5/417 X |
| 4,466,517 | 8/1984 | Spiegelman | 5/419 X |
| 4,468,810 | 8/1984 | Longo | 5/417 X |
| 4,512,049 | 4/1985 | Henry | 5/417 |
| 4,516,668 | 5/1985 | Grayek | 5/417 X |
| 4,536,028 | 8/1985 | Jones et al. | 5/482 |
| 4,600,091 | 7/1986 | McLeod | 5/417 X |

FOREIGN PATENT DOCUMENTS

| | | | |
|---|---|---|---|
| 819449 | 10/1951 | Fed. Rep. of Germany | 5/417 |
| 3325142 | 1/1985 | Fed. Rep. of Germany | 297/218 |
| 2400873 | 4/1979 | France | 5/417 |
| 2540366 | 8/1984 | France | 5/417 |

*Primary Examiner*—Alexander Grosz

*Attorney, Agent, or Firm*—Burmeister, York, Palmatier, Hamby & Jones

[57] ABSTRACT

A lounge chair with a beach mat resting upon the lounge chair in which the beach mat has a flap at one end which extends for a distance of 1/5 to 1/6 of the length of the beach mat and which accommodates the end of the back of the lounge chair to secure the beach mat on the lounge chair. The mat may be removed from the lounge chair and folded on the side of the flap four or five times to provide a flat roll, and folded one additional time to place the mat in the flap. The flap may thereafter be folded along the longitudinal axis of the mat and fasteners are provided to secure the mat in folded position, thus exposing the open end of the flap to receive articles.

4 Claims, 2 Drawing Sheets

BEACH MAT ADAPTED FOR USE ON A LOUNGE CHAIR

INTRODUCTION

The present invention relates to beach mats for drying a person's body after bathing, use on a beach, or on a lounge chair.

Beach mats are used for a number of different purposes. One use of beach mats is to dry a person's body after swimming. Thereafter, the person may desire to lie on the mat in the sun and sunbathe. For both of these uses it is desirable that the mat be water absorbent. If the person desires to rest upon a lounge chair, it is desirable to place the beach mat on the chair in order to provide a soft water absorbent surface. Conventional beach mats have no means for attachment to the lounge chair, and accordingly rest unstably on the lounge chair.

It is therefore an object of the present invention to provide an improved beach mat which may be removably mounted on a lounge chair and which will provide the basic functions of a beach mat.

A beach mat is of necessity a large bulky item, and it thus becomes awkward to transport it to the beach or other location of use. U.S. Pat. No. 2,898,609 to R. J. Storie discloses an attachment to a beach mat which serves as a cover for transporting the folded mat. It is an object of the present invention to provide a beach mat in the form of an integral unit which may be folded into a relatively small package and secured in that form for transport.

Not only is it necessary to transport a beach mat to the location of use, but it is also generally desirable or necessary to transport a number of other items along with the beach mat, such as lotion, cosmetics and beauty aids, reading material and the like. A separate carrying case for such items is often used, but the separate carrying case introduces an inconvenience to the user. It is therefore an object of the present invention to provide a beach mat in the form of an intergral unit which may be folded into a relatively small package for transport and which is provided with an accessible pocket for carrying other items.

THE INVENTION

The present inventor has provided a beach mat in the form of a rectangular pad of water absorbent materials which has a face side upon which a person may lounge or lie. The reverse side is adapted to be positioned on a beach or other supporting surface or a lounge chair. The pad is provided with a flab located at one end of the pad and extending completely across that end to form a pocket, and the pocket is adapted to fit over the upper portion of the back of the lounge chair to retain the mat in position on the lounge chair. The mat is adapted to be folded a plurality of times to form a flat roll positioned at the open edge of the flap, and then the mat is adapted to be folded an additional time to position the flat roll into the pocket formed by the flap. A further fold along the major longitudinal axis of the mat toward the front side of the mat further reduces the size of the package, and a strap mounted on the flap adjacent to the edge of the mat is stretched and secured by a fastener on the flap adjacent to the opposite edge of the mat, the strap retaining the package in a stable condition and forming a handle for carrying the mat. Due to the fact that the final fold is toward the face side of the mat, the open edge of the flap is exposed and objects may be placed in the flap for transport. The mat is also provided with loops extending outwardly from the open edge of the flap to facilitate carrying of the mat with any contents it may have.

THE DRAWINGS

The objects and advantages of the present invention will be more fully explained in connection with the preferred construction thereof illustrated in the drawings, in which.

DESCRIPTION OF PREFERRED EMBODIMENT

Figure 1:
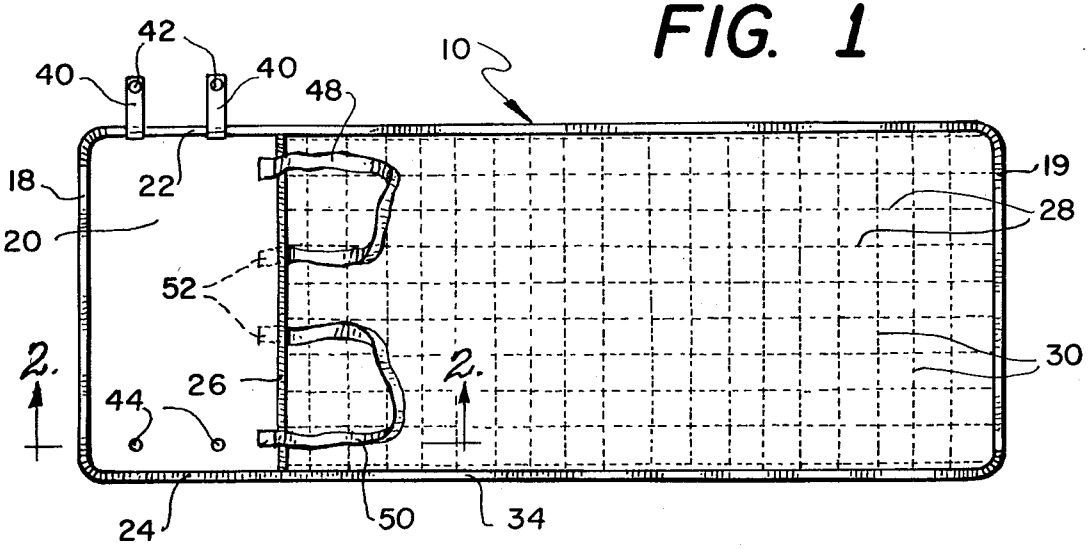
FIG. 1 is an elevational view of the backside of a mat constructed according to the teachings of the present invention.
Figure 2:
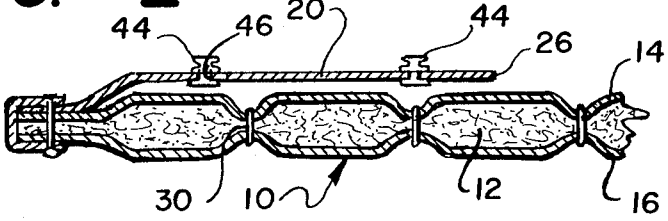
FIG. 2 is a sectional view taken along the line 2—2 of FIG. 1.

As illustrated in the figures, the beach mat has a rectangular pad 10 which comprises three layers 12, 14, and 16. The central layer 12 is preferably constructed of water absorbent material, such as cotton padding. The layer 12 may also be constructed of synthetic fibers, such as polyester fill, to increase the dimensional stability of the pad, but the water absorbency of the layer will be essentially lost. The back layer 14 and front layer 16 are also preferably constructed of water absorbent material, such as cotton cloth. The front layer 16 is the surface of the mat upon which the user lies, and the layer 14 forms the surface of the mat which rests upon the lounge chair 17 or supporting surface.

The mat may be considered to have a top end 18 and a bottom end 19, and a flap 20 extends across the rear layer 14 at the end 18, the flap being secured on the pad 10 at the end 18 and along the adjacent portions of the two edges 22 and 24. The flap 20 is rectangular in shape, and secured on three of its four edges to form a pocket, the edge 26 opposite the top end 18 being open.

The pad 10 has a plurality of rows 28 of stitching parallel to the edges 22 and 24, and a second plurality of rows 30 of stitching parallel to the ends 18 and 19 of the pad. The rows of stitching 28 and 30 hold the cotton layer 12 in proper position, and anchor the three layers 12, 14, and 16 together.

A U-shaped edging 34 extends about the perimeter of the pad 10, the edging being a narrow strip of cloth which overlaps a narrow strip portion of the layers 14 and 16 and the flap 20. The edging 34 is not only decorative, but serves to prevent fraying of the edges of the pad.

Since the pad 10 is rectangular, it has a major axis disposed centrally between the edges 22 and 24 and parallel to those edges, and a central minor axis disposed centrally between the ends 18 and 19 and parallel to those ends. The edge 26 of the flap 20 is parallel to the minor axis, and is displaced from the top end 18 of the pad by a distance between 1/5 and 1/6 of the distance between the top end 18 and bottom end 19 of the pad.

Figure 3:
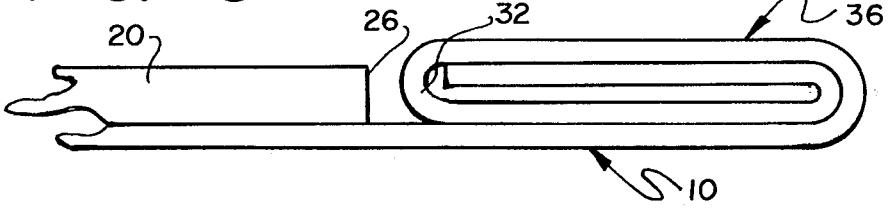
FIG. 3 is a side elevational view of the mat of FIG. 1 folded into a flat roll prior to insertion in the pocket formed by the flap.
Figure 4:
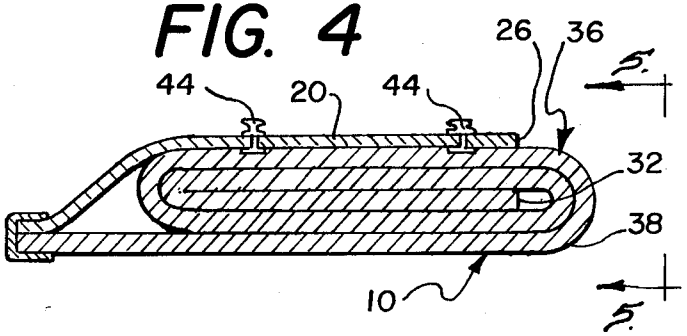
FIG. 4 is a sectional view taken along the line 2—2 of FIG. 1 showing the flat roll folded into the pocket formed by the flap.

The bottom end 19 of the pad may thus be folded to a line ½ the distance of the minor axis of the pad. Thereafter, the pad may be in essence rolled up, or folded, twice more to produce a flat roll, as indicated at 36 in FIG. 3. This flat roll will confront the open end 26 of the pocket formed by the flap 20, and may be folded over into the flap for storage, as indicated in FIG. 4. It will be noted that a curved ridge portion 38 protrudes from the open end 26 of the flap 20.

It will be noted that a pair of spaced straps 40 extend outwardly from the flap 20 adjacent to the edge 22, and each of the straps 40 is provided with a fastener 42 adjacent to the end opposite the flap 20. The flap 20 is also provided with a pair of fasteners 44 mounted in apertures 46 adjacent to the edge 42 of the flap, and the fasteners 42 of the strips 40 are adapted to mate in releasable engagement with the fasteners 44 mounted on the flap 20.

Figure 5:
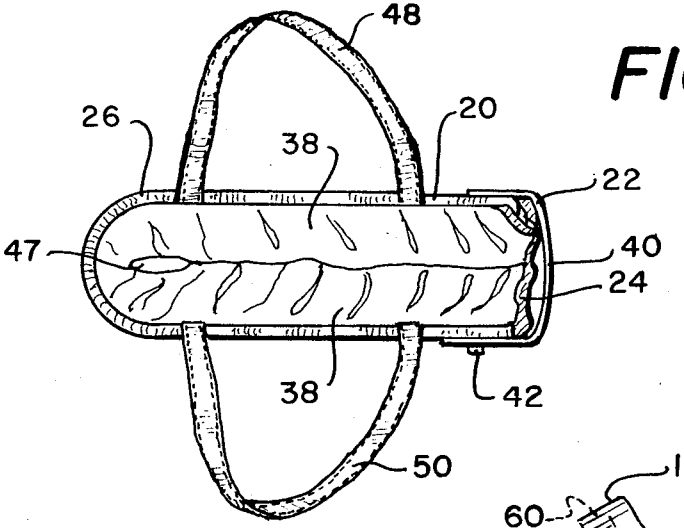
FIG. 5 is a top elevational view taken along the line 5—5 of FIG. 4 of the mat in its fully folded position.

When the flat roll 32 is disposed within the pocket formed by the flap 20, it forms an elongated body which may be folded toward the face side of the pad, that is, the side opposite the flap 20. FIG. 5 illustrates such a fold at 47, and it will be noted that the pad is fully folded through 180° so that the edges 22 and 24 abut each other. In this configuration, the flap 20 is disposed on the outside, and presents its open edge 26 adjacent to the curved ridge portion 38, as illustrated in FIGS. 4 and 5. The straps 40 are then curved about the edges 22 and 24 and the fasteners 42 on the strips 40 engage the fasteners 44 on the flap 20, thereby holding the edges 22 and 24 in adjacent relationship.

The straps 40 may be used as handles for purposes of carrying the folded pad. Further, the fact that the open edge 26 of the flap 20 is exposed, permits objects to be placed in the pocket in this folded condition. Since the pad has been folded relatively flat, flat items may be inserted into the pocket formed by the flap, or small items of any shape may be inserted into the pocket because of the resiliency of the pad. In this manner, the mat may be conveniently carried to its location of use and objects may be carried along with the mat.

While the straps 40 may be used to carry the mat, use of the straps tends to position the open end 20 of the flap vertically, thus making it possible to lose items from within the flap. Accordingly, a pair of loops 48 and 50 are mounted on the open edge 26 of the flap 20 so that the loops will extend outwardly from the edge 26 of the flap 20 when the mat is folded into the pocket for carrying convenience. The loops 48 and 50 have ends disposed within the pocket and are sewn in place as indicated by the dotted lines at 52.

Figure 6:
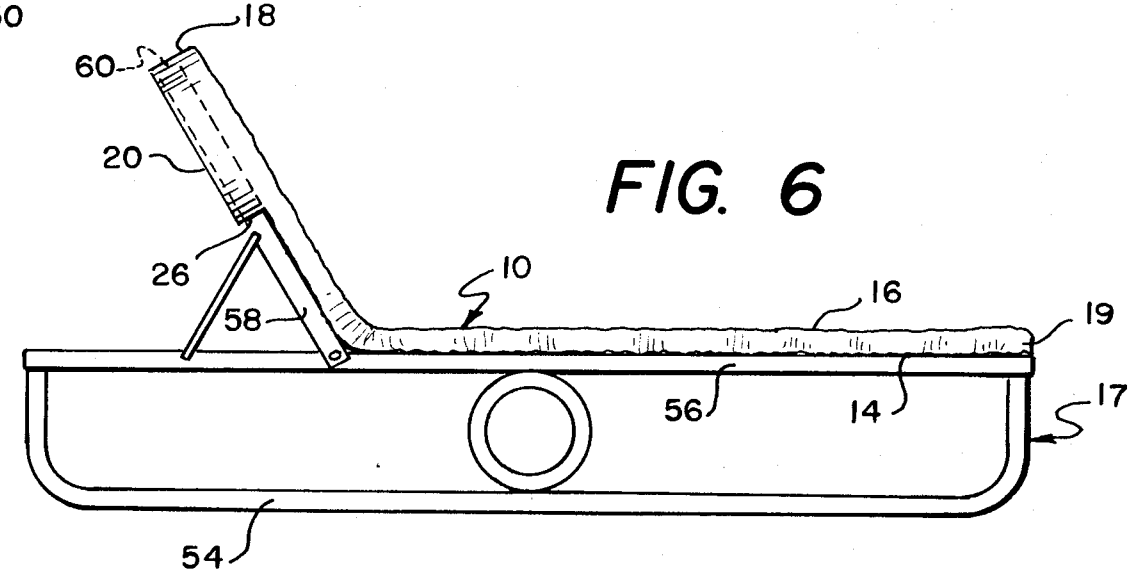
FIG. 6 is a side elevational view of the mat mounted on a lounge chair.

FIG. 6 illustrates the lounge chair 17 with the mat 10 mounted on the lounge chair. The lounge chair has a frame 54 which supports a flat bed 56. A back 58 extends upwardly at an angle from the bed 56 and has a flat upper end 60. The mat 10 rests upon the bed 56 with the flap 20 extending downwardly on the rear side of the back 58, and the top end 18 of the mat engages the upper end 60 of the back 58.

In a preferred construction of the mat, the major axis of the mat had a length of 72 inches, and the flap 20 extended a distance of 14 inches from the edge 18. The mat had a width of 28 inches. The straps 40 extended outwardly from the mat a distance of 4½ inches and were 1 3/16 inches in width. The straps 40 carried female connectors, the male connectors being mounted on the flap.

Those skilled in the art will find applications for the foregoing inventions over and above those here disclosed. It is therefore intended that the scope of the present invention be not limited by the foregoing specification, but rather only by the appended claims.

The invention claimed is:

1. A beach mat for use on a lounge chair or a supporting surface comprising a rectangular pad of flexible, foldable, low resilience, water absorbent materials having a major central axis of elongation extending between opposite ends thereof and a minor central axis of elongation extending between opposite edges of the pad, said pad having a face side adapted to form a surface for supporting a person and an opposite rear side adapted to be in contact with the surface of a lounge chair or supporting surface, a flap of material extending across the rear side of the pad at one-end thereof and extending from said one-end toward the opposite end of the pad to an edge disposed at a distance from the one-end of the pad beween 1/5th and 1/6th of the length of the major axis of elongation of the pad, said flap being attached to the pad at the one-end and the adjacent portions of the edges of the pad and forming a pocket closed at the one-end and edge portions of the mat and open at the edge of the flap, the pocket formed by the flap having a width measured parallel to the minor axis of the pad at the edge of the flap approximately equal to the length of the minor axis of the pad, the flap being adapted to receive the upper portion of the back of a lounge chair and accomodate said portion of the back to anchor the mat on the lounge chair, said mat being adapted to fold toward the back side thereof between four and five times to form a flat roll adjacent to the edge of the flap, said mat being adapted to fold an additional time toward the back side along an axis parallel to and adjacent to the edge of the flap, the flat roll being insertable in the flap for storage on said additional fold wherein the pad, with the flat roll disposed in the pocket, is adapted to fold along the major axis of elongation of the pad through an angle of approximately 180 degrees, the pad being adapted to fold along the major axis in a direction toward the front side of the pad, whereby the edge of the pocket is exposed to receive objects, and fastener means mounted on the pad adapted to retain the pad in folded position.

2. A beach mat for use on a lounge chair or supporting surface comprising the combination of claim 1 wherein the pad is constructed of a pair of layers of fabric and a layer of quilting material between the layers of fabric, the pad having a plurality of rows of stitching extending through the layers of fabric and the layer of quilting material.

3. A beach mat for use on a lounge chair or supporting surface comprising the combination of claim 1 wherein the fastener means comprises a strap mounted on the flap adjacent to one edge of the pad, and releasable fastening means mounted on the flap adjacent to the other edge of the pad, whereby the strap secures the pad in folded condition and functions as a carrying handle.

4. A lounge chair having a removable beach mat comprising, in combination: a frame, a flat bed mounted on the frame, a back extending from the bed having a forward side confronting the bed and a rearward side, and a beach mat disposed on the bed and back, the beach mat having a rectangular pad of flexible, foldable, low resilience, water absorbent materials having a major central axis of elongation extending between the opposite ends thereof and a minor central axis of elongation extending between opposite edges of the pad, the axis of elongation traversing the bed and the back of the lounge, said pad having a face side adapted to support a person and an opposite rear side abutting the bed and back of the lounge chair, said beach mat having a flap of material extending across the rear side of the pad at the end adjacent to the back and extending from said end on the side of the back opposite the pad to an edge disposed at a distance from said end of the pad between 1/5 and 1/6 of the length of the major axis of elongation of the pad, said flap being attached to the pad at the said end and the adjacent portions of the edges of the pad and forming a pocket closed at the said end and edge portions of the mat and open at the edge of the flap, the pocket formed by the flap having a width measured parallel to the minor axis of the pad at the edge of the flap approximately equal to the length of the minor axis of the pad, said mat being adapted to be removed from the lounge chair and to fold toward the back side thereof between four and five times to form a flat roll adjacent to the edge of the flap, said mat being adapted to fold an additional time toward the back side along an axis parallel to and adjacent to the edge of the flap, the flat roll being insertable in the flap for storage on said additional fold wherein the pad, with the flat roll disposed in the pocket, is adapted to fold along the major axis of elongation of the pad through an angle of approximately 180 degrees, the pad being adapted to fold along the major axis in a direction toward the front side of the pad, whereby the edge of the pocket is exposed to receive objects, and fastener means mounted on the pad adapted to retain the pad in folded position.

* * * * *